US006753827B2

(12) United States Patent
Oshiyama et al.

(10) Patent No.: US 6,753,827 B2
(45) Date of Patent: Jun. 22, 2004

(54) ANTENNA DEVICE FOR MOBILE COMMUNICATION TERMINAL

(75) Inventors: Tadashi Oshiyama, Gunma (JP); Seiji Gou, Gunma (JP)

(73) Assignee: Yokowo Co., Ltd., Tokyo (JP)

( * ) Notice: Subject to any disclaimer, the term of this patent is extended or adjusted under 35 U.S.C. 154(b) by 0 days.

(21) Appl. No.: 10/342,225

(22) Filed: Jan. 15, 2003

(65) Prior Publication Data

US 2003/0132886 A1 Jul. 17, 2003

(30) Foreign Application Priority Data

Jan. 15, 2002 (JP) ..... P.2002-005974

(51) Int. Cl.[7] ..... H01Q 3/24
(52) U.S. Cl. ..... 343/876; 343/702
(58) Field of Search ..... 343/702, 725, 343/876; 455/277.1, 575

(56) References Cited

U.S. PATENT DOCUMENTS 4,914,714 A * 4/1990 Tamura ..... 455/78
5,701,603 A * 12/1997 Norimatsu ..... 455/277.1
5,722,089 A * 2/1998 Murakami ..... 455/575.7
5,867,127 A * 2/1999 Black et al. ..... 343/702
6,211,830 B1 * 4/2001 Monma et al. ..... 343/702
6,522,300 B2 * 2/2003 Oshiyama et al. ..... 343/702

* cited by examiner

*Primary Examiner*—Hoang V. Nguyen
(74) *Attorney, Agent, or Firm*—Morgan, Lewis & Bockius LLP

(57) ABSTRACT

A first antenna is movable between a first position pulled out from the communication terminal and a second position accommodated in a mobile communication terminal. A second antenna is built in the communication terminal. A first switch electrically connects only the first antenna with a power feeding circuit via an impedance matching circuit when the first antenna is placed at the first position, and electrically connects only the second antenna with the power feeding circuit when the first antenna is placed at the second position. A second switch grounds the second antenna in cooperation with the first switch, when the first antenna is placed at the second position.

12 Claims, 14 Drawing Sheets

ANTENNA DEVICE FOR MOBILE COMMUNICATION TERMINAL

BACKGROUND OF THE INVENTION

The present invention relates to an antenna device for a mobile communication terminal, and more particularly to an antenna device for a mobile communication terminal which is suitable for a mobile phone.

There are various types of antenna devices for a mobile phone. In particular, recently, a combination of a pull-out type rod-shaped (whip) antenna and a built-in antenna has been proposed. This has an object to satisfy a requirement for such an antenna structure as to sufficiently maintain an antenna sensitivity and to have no protrusion during the storage of an antenna in respect of a design.

As a result of the use of the two antennas, there has been proposed a structure in which a feeding circuit is connected to the rod-shaped antenna or the built-in antenna through a changeover switch.

FIGS. 14A and 14B are diagrams showing a switching circuit having a structure using the two antennas. In FIG. 14A, a rod-shaped antenna WA is pulled out and is connected to a feeding circuit FC through an impedance matching circuit MC1. On the other hand, in a built-in antenna IA, a switch member SB1 disconnects a feeding terminal IFC1 from a matching circuit terminal MFC1 and a switch member SB2 disconnects both ground terminals IGC1 and GC1, and only the rod-shaped antenna WA is connected to the feeding circuit FC.

In contrast, in FIG. 14B, the rod-shaped antenna WA is disconnected from the matching circuit MC1 and is grounded through a matching circuit MC2 having a high impedance. The feeding terminal of the built-in antenna IA is connected to the feeding circuit FC through the switch member SB1, and furthermore, the ground terminal of the built-in antenna IA is connected through the switch member SB2.

In FIGS. 15A and 15B, in order to change over the rod-shaped antenna WA and the built-in antenna IA, a cam CM for pulling out the rod-shaped antenna WA and operating in response to a storage operation is provided and the button of a switch SW is caused to appear frequently by means of the cam CM.

Thus, the rod-shaped antenna WA and the built-in antenna IA can be changed over.

In a mobile phone, a frequency band to be used has further been expanded and a multiband antenna has been required.

For the multiband communication, however, the matching circuit MC2 in FIGS. 14A and 14B is to carry out impedance matching for at least two frequency bands, which is difficult. For this reason, it is hard to constitute the multiband antenna in the antenna having the above structure.

SUMMARY OF THE INVENTION

It is therefore an object of the invention to provide an antenna device for a mobile communication terminal which changes over and uses a band-shaped antenna and a built-in antenna and does not cause impedance mismatching for multiband communication.

In order to achieve the above object, according to the invention, there is provided an antenna device, incorporated in a mobile communication terminal, comprising:

a first antenna, movable between a first position pulled out from the communication terminal and a second position accommodated in the communication terminal;

a second antenna, built in the communication terminal;

a power feeding circuit;

an impedance matching circuit;

a first switch, which electrically connects only the first antenna with the power feeding circuit via the impedance matching circuit when the first antenna is placed at the first position, and electrically connects only the second antenna with the power feeding circuit when the first antenna is placed at the second position; and a second switch, which grounds the second antenna in cooperation with the first switch, when the first antenna is placed at the second position.

In such a configuration, the grounding circuit of the second antenna is disconnected by the second switch cooperated with the first switch when the first antenna is stored in the communication terminal. Therefore, when the feeding circuit is connected to the second antenna, an element related to the first antenna is isolated from the feeding circuit. Thus, the feeding circuit is not influenced by the element related to the first antenna. As a result, it is possible to provide an antenna which does not cause a drawback by multibanding.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1A:
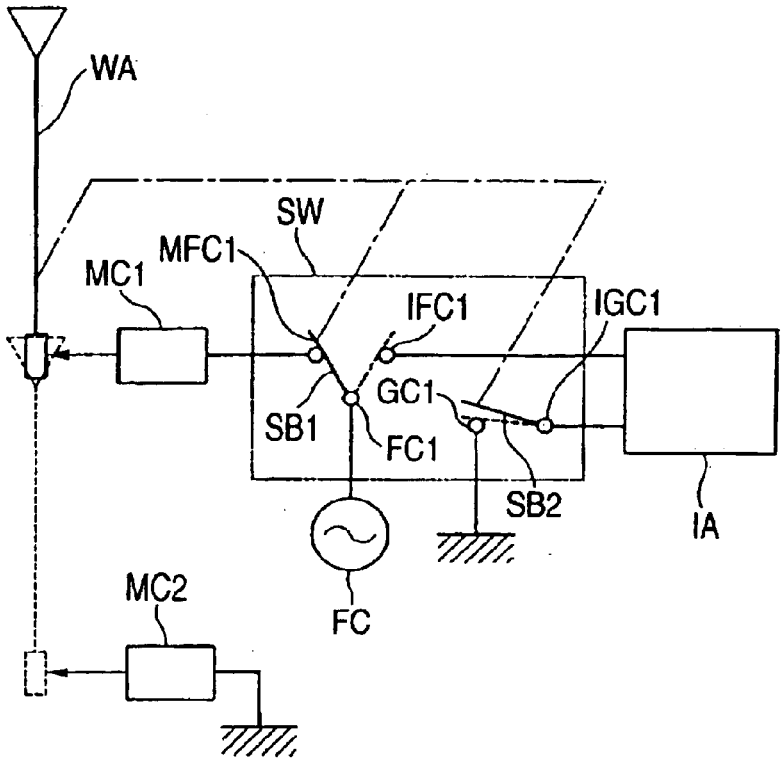
FIGS. 1A and 1B are diagrams illustrating a circuit structure of an antenna device according to a first embodiment of the invention.
Figure 1B:
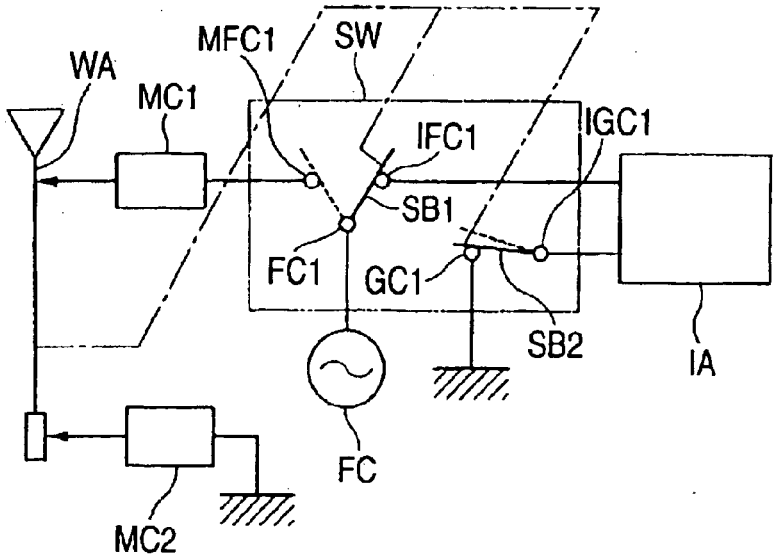

FIGS. 1A and 1B are views showing the state of an antenna switching connection which is obtained when a rod-shaped antenna in an antenna switching circuit according to a first embodiment of the invention is pulled out and stored. The switching connection is carried out by changing over a switch SW corresponding to the pull-out and storage of a rod-shaped antenna WA.

The switch SW serves to carry out switching operations by two switch members SB1 and SB2. For one of the switching operations, a feeding circuit terminal FC1 connected to a feeding circuit FC is changed over and connected, through the switch member SB1, to a matching circuit terminal MFC1 connected to a matching circuit MC1 and a built-in antenna feeding terminal IFC1 connected to the feeding terminal of a built-in antenna IA. For the other switching operation, a ground terminal IGC1 of the built-in antenna IA is disconnected and connected, through the switch member SB2, from and to a ground terminal GC1 connected to the ground terminal of a circuit board (not shown).

In this case, three respects are required for the switch SW, that is, a voltage standing wave ratio (VSWR) is to be excellent, a high isolation is to be obtained and an insertion loss is to be reduced.

As shown in FIG. 1A, when a rod-shaped antenna WA is pulled out, it is connected to the feeding circuit FC through the impedance matching circuit MC1, the matching circuit terminal MFC1 of the switch SW, the switch member SB1 and the feeding circuit terminal FC1. At this time, the built-in antenna IA is not connected to any of the switch members SB1 and SB2 of the switch SW but is disconnected from the feeding circuit FC. As a result, the feeding circuit FC is brought into such a state as to be connected to the rod-shaped antenna WA.

On the other hand, when the rod-shaped antenna WA is stored, the switch member SB1 in the switch SW is switched into the feeding terminal IFC1 of the built-in antenna IA so that the feeding circuit FC is connected to the built-in antenna IA, and furthermore, the switch member SB2 connects the ground terminal IGC1 of the built-in antenna IA to the ground terminal GC1. Consequently, the feeding circuit FC is brought into such a state as to be connected to the built-in antenna IA. At this time, two matching circuits MC1 and MC2 are connected to the rod-shaped antenna WA or the matching circuit MC1 and a short circuit are connected to the rod-shaped antenna WA, and they are disconnected from the feeding circuit FC.

Consequently, the matching circuit MC2 or the short circuit has a high impedance when the rod-shaped antenna WA is seen from the feeding portion side of an RF circuit. Thus, the isolation of the rod-shaped antenna WA and the built-in antenna IA can be more increased so that an interference between the respective antennas can be decreased.

Figure 2:
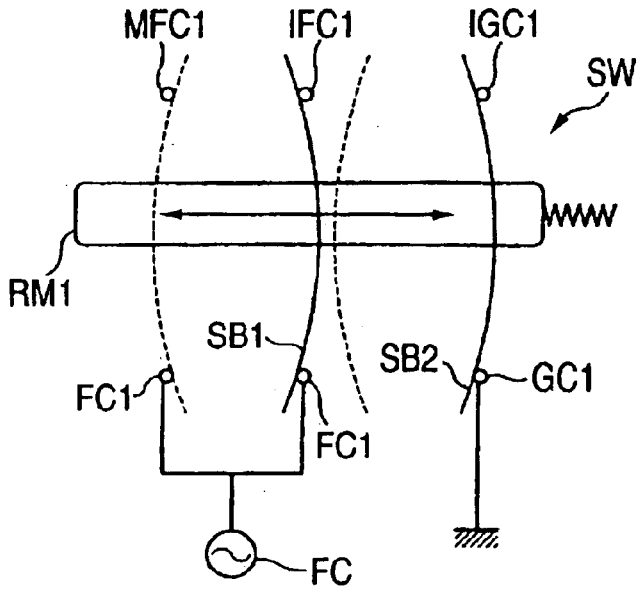
FIG. 2 is a view schematically illustrating the internal structure of a switch to be used in the circuit shown in FIG. 1.

FIG. 2 schematically shows the internal structure of the switch SW. In this figure, a ram RM1 provided on almost the center is dragged in a rightward direction in the drawing by the attractive force of a coil spring during the storage of the rod-shaped antenna (not shown) and is movable in a leftward direction in the drawing corresponding to the pull-out of the rod-shaped antenna WA.

Elastic arcuate switch members SB1 and SB2 to be movable contact members are attached to the ram RM1. The switch member SB1 changes over and connects a feeding circuit terminal FC1 to a matching circuit terminal MFC1 and a built-in antenna terminal IFC1 corresponding to the movement of the ram RM1 in a transverse direction in the drawing, and furthermore, the switch member SB2 connects or disconnects a built-in antenna ground terminal IGC1 to a circuit board ground terminal GC1. For the switch members SB1 and SB2 shown in the drawing, a solid line indicates a state in which a rod-shaped antenna is stored and a dashed line indicates a state in which the rod-shaped antenna is pulled out.

Figure 3:
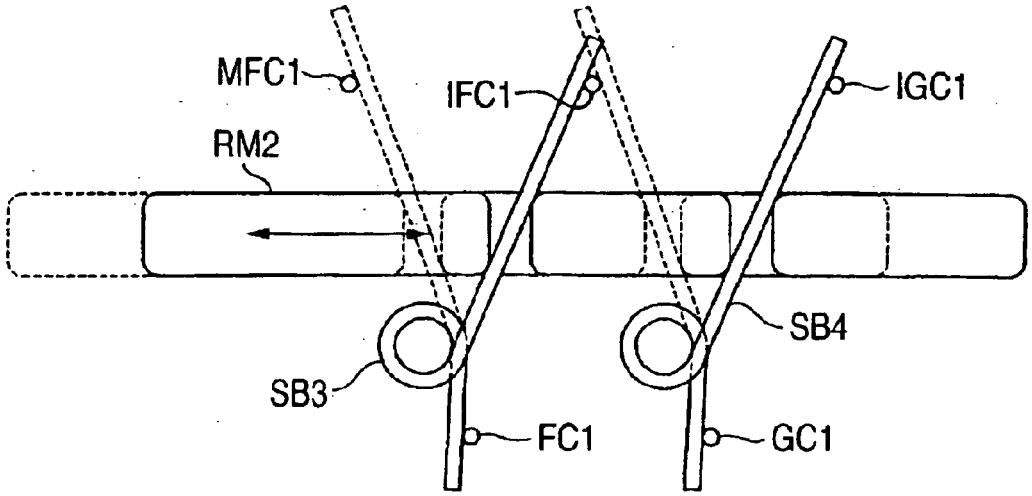
FIG. 3 is a view illustrating a switch according to a second embodiment of the invention.

FIG. 3 shows a switch according to a second embodiment of the invention. In this embodiment, a coil spring having an almost one turn which includes a pull-out portion on both ends, for example, a torsion spring is used for switch members SB3 and SB4 to be movable contact members, and the pull-out portion on one of the ends of the switch member SB3 is engaged with a feeding circuit terminal FC1 and the pull-out portion on the other end is engaged with a built-in antenna feeding terminal IFC1 through a groove provided in a ram RM2. The switch member SB4 has one of ends engaged with a ground terminal GC1 and the other end engaged with a built-in antenna ground terminal IGC1 through another hole provided on the ram RM2. In this state, a rod-shaped antenna (not shown) is stored and a built-in antenna (not shown) is connected to a feeding circuit (usual state).

Figure 4A:
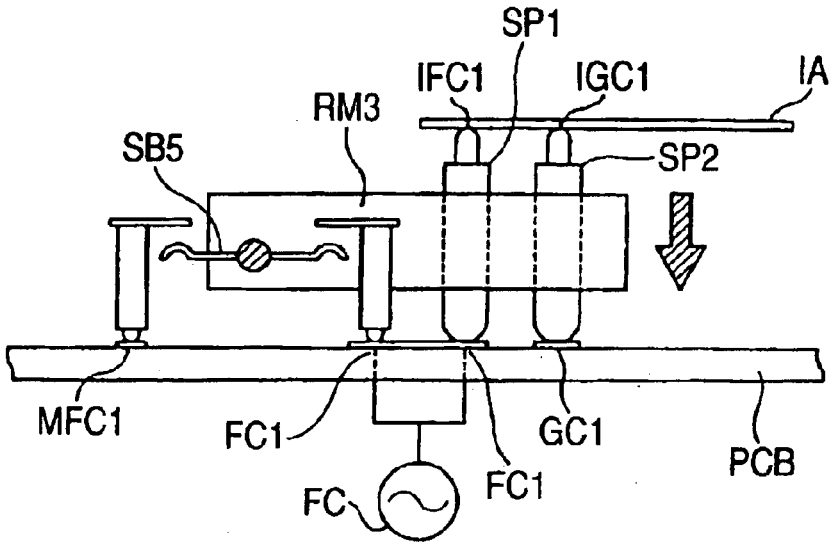
FIGS. 4A and 4B are views illustrating a switch according to a third embodiment of the invention.
Figure 4B:
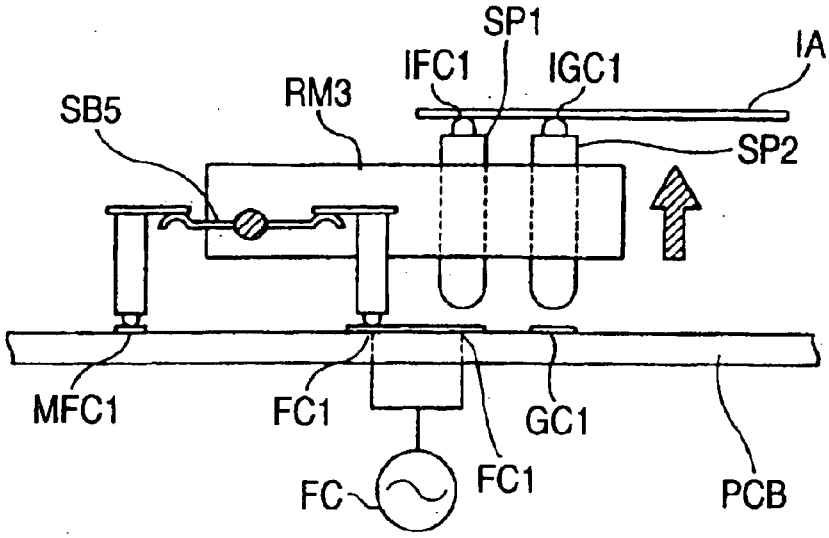

FIGS. 4A and 4B show a switch SW according to a third embodiment of the invention. In this embodiment, the switch SW is constituted by utilizing a space between a built-in antenna IA and a circuit board PCB, and a ram RM3 for being moved to approach one of the built-in antenna IA and the circuit board PCB and to separate from the other in the space is provided. A switch member SB5 and spring connectors SP1 and SP2 to be movable contact members are operated by the ram RM3.

In this case, a first switch is constituted to change over and connect a feeding circuit FC and two antennas WA and IA by connecting and disconnecting the switch member SB5 to and from two fixed contact points (terminals) FC1 and MFC1, and connecting and disconnecting the spring connector SP1 to and from the contact point (terminal) FC1. Moreover, a second switch connects and disconnects a circuit for the built-in antenna IA when the spring connector SP2 is connected to and disconnected from the contact point (terminal) GC1.

When a rod-shaped antenna (not shown) is set in a storage state, the ram RM3 is moved in a downward direction as shown in FIG. 4A so that the switch member SB5 separates from the terminals MFC1 and FC1, and a feeding circuit FC is disconnected from a matching circuit terminal MFC1 and is connected to a built-in antenna feeding circuit terminal IFC1 through the spring connector SP1. At this time, a built-in antenna ground terminal IGC1 is connected to a ground terminal GC1 of the circuit board PCB through the spring connector SP2. Accordingly, the built-in antenna IA is connected to the feeding circuit FC. At this time, a circuit to be coupled to the rod-shaped antenna is disconnected in two places, that is, between the switch member SB5 and the matching circuit terminal MFC1 and between the switch member SB5 and the feeding circuit FC. Therefore, a high isolation can be taken.

When the rod-shaped antenna is pulled out, the ram RM3 is moved upward as shown in FIG. 4B. Consequently, the switch member SB5 comes in contact with two terminals MFC1 and FC1, and connects them so that the feeding circuit terminal FC is connected to the matching circuit terminal MFC1. On the other hand, the lower end of the spring connector SP1 shown in the drawing separates from the circuit board PCB. Moreover, the lower end of the spring connector SP2 shown in the drawing also separates from the circuit board PCB. Accordingly, only the rod-shaped antenna is connected to the feeding circuit FC.

Figure 5A:
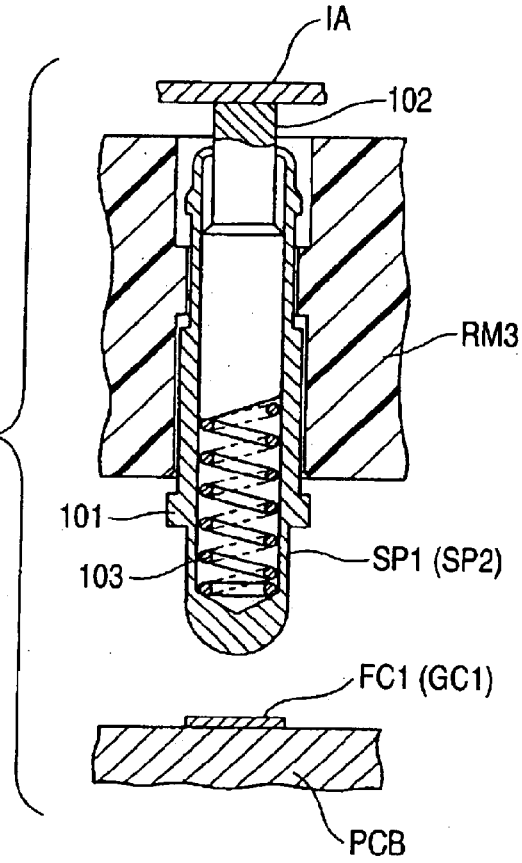
FIGS. 5A and 5B are views showing the detailed structure of a spring connector in the switch of the third embodiment.
Figure 5B:
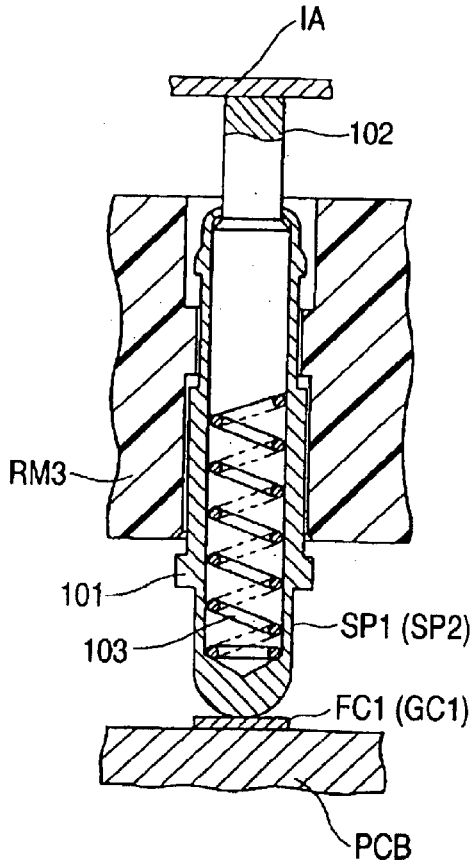

FIGS. 5A and 5B are longitudinal sectional views illustrating the detailed structure of the spring connectors shown in FIGS. 4A and 4B. Each of the spring connectors comprises a case 101 having an almost cylindrical whole shape, an extensible coil spring 103 and a movable rod 102 to which axial and outward acting force is given by the coil spring 103, and is formed such that an outer periphery is held in the ram RM3. All of these members 101, 102 and 103 are formed of metal.

When the ram RM3 approaches the built-in antenna IA as shown in FIG. 5A, the lower end of the case 101 separates to be disconnected from the conductive pattern of the circuit board PCB. When the ram RM3 separates from the built-in antenna IA as shown in FIG. 5B, the lower end of the case 101 approaches the circuit board PCB and is connected to the conductive pattern. The movable rod 102 always comes in contact with the built-in antenna IA by the urging force of the coil spring 103.

Figure 6A:
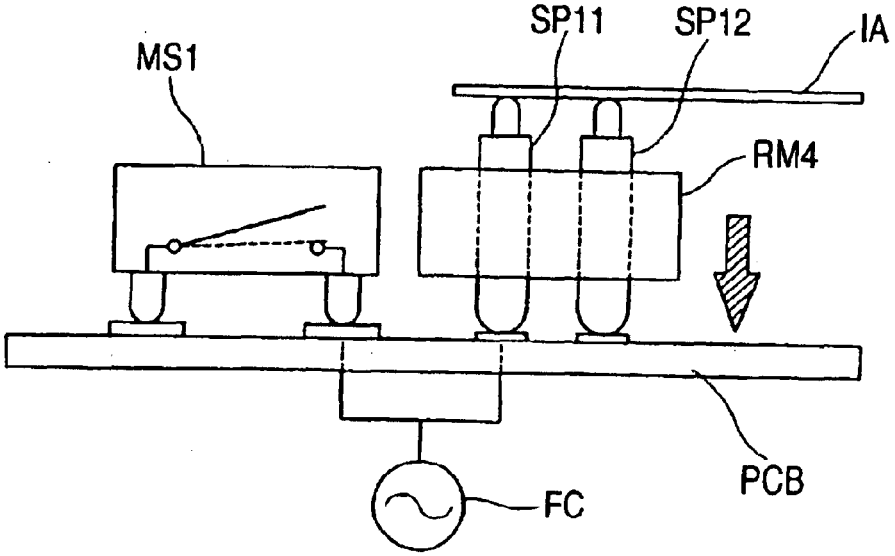
FIGS. 6A and 6B are views illustrating a switch according to a fourth embodiment of the invention.
Figure 6B:
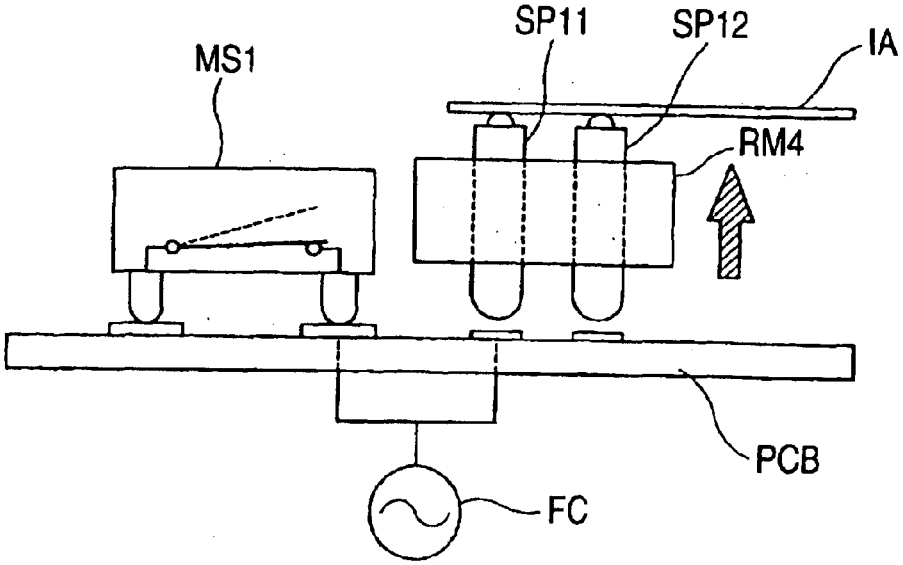

FIGS. 6A and 6B show a switch according to a fourth embodiment of the invention. In this embodiment, the switch member SB5 in the third embodiment is replaced with a microswitch MS1. In this case, it is necessary to provide a member (not shown) for transmitting the operation of a ram RM4 to an actuator (not shown) of the microswitch MS1 in order to actuate the actuator of the microswitch MS1.

When a rod-shaped antenna (not shown) is stored, the ram RM4 is moved downward as shown in FIG. 6A. Consequently, the lower ends of spring connectors SP11 and SP12 come in contact with the circuit board PCB. At this time, the motion of the ram RM4 is also transmitted to the actuator of the microswitch MS1 so that a switch is opened.

Next, when the rod-shaped antenna is pulled out, the ram RM4 is moved upward as shown in FIG. 6B so that the lower ends of the spring connectors SP11 and SP12 separate from the circuit board PCB. The motion of the ram RM4 is transmitted to the microswitch MS1 so that the switch is closed.

Figure 7A:
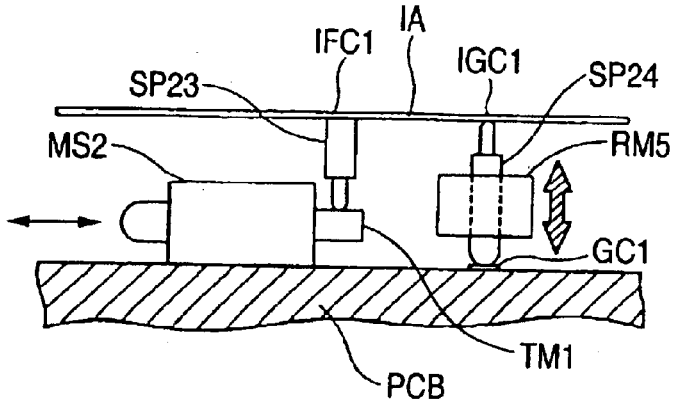
FIGS. 7A and 7B are a side view and a plan view of a switch according to a fifth embodiment of the invention.
Figure 7B:
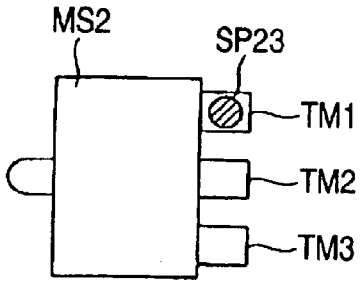
Figure 7C:
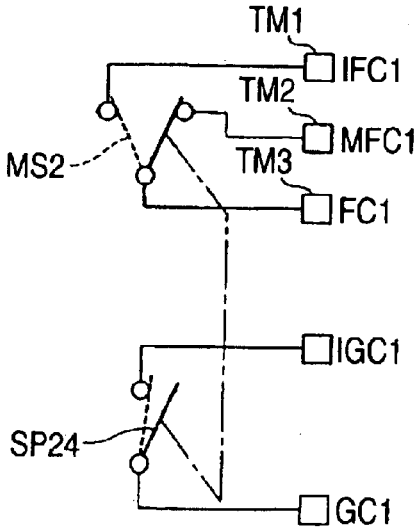
FIG. 7C is a diagram showing a circuit structure of the switch of the fifth embodiment.

FIGS. 7A, 7B and 7C show a switch according to a fifth embodiment of the invention. As shown in FIGS. 7A and 7B, a microswitch MS2 and a spring connector SP24 are provided in the embodiment. The circuit structure is constituted by the microswitch MS2 of a switching type and the spring connector SP24 as shown in FIG. 7C. The microswitch MS2 is provided with terminals TM1, TM2, TM3 respectively connected to the feeding circuit terminal IFC1, the matching circuit terminal MFC1 and the feeding circuit FC1 via spring connectors (not shown except a spring connector SP23).

When a rod-shaped antenna WA (not shown) is stored, a ram RM5 shown in FIG. 7A is moved downward to bring a lower end of the spring connector SP24 into contact with a terminal GC1 on a circuit board PCB (indicated by a lower dashed line in FIG. 7C). At this time, the microswitch MS2 is also actuated so that electric conduction between the feeding circuit FC1 and the feeding circuit terminal IFC1 via the spring connector 23 is established (indicated by FIG. 7B and an upper dashed line in FIG. 7C).

When the rod-shaped antenna WA is pulled out, the ram RM5 is moved upward to separate the lower end of the spring connector 24 from the terminal GC1 (indicated by a lower solid line in FIG. 7C). At this time, the microswitch MS2 is also actuated so that the electric conduction between the feeding circuit FC1 and the matching circuit terminal MFC1 via a not shown spring connector is established (indicated by an upper solid line in FIG. 7C).

Figure 8B:
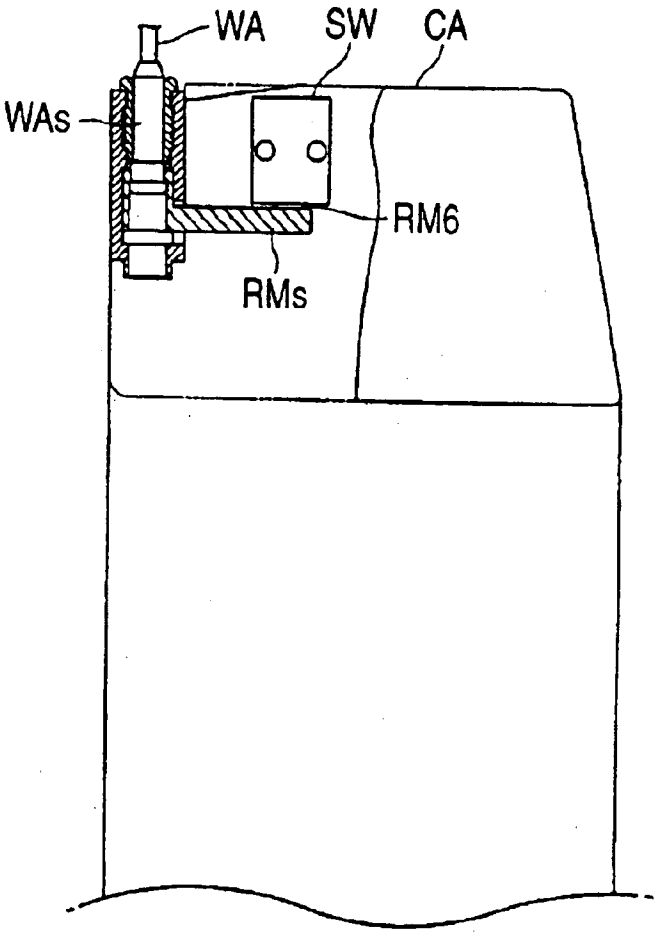
FIGS. 8A and 8B are sectional views showing a switch according to a sixth embodiment of the invention.
Figure 8A:
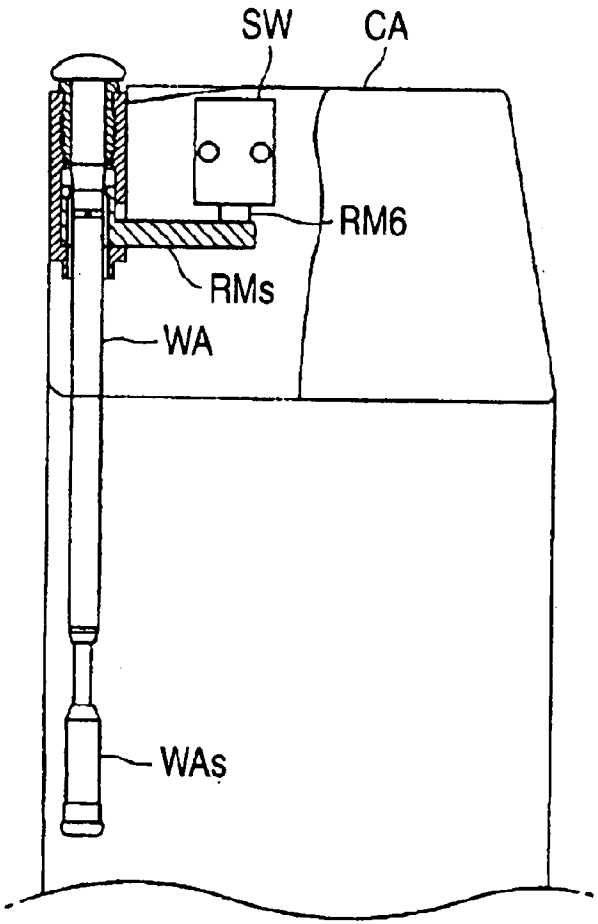

FIGS. 8A and 8B show a switch according to a sixth embodiment of the invention. FIG. 8A shows a state in which a rod-shaped antenna WA is stored and FIG. 8B shows a state in which the rod-shaped antenna WA is pulled out. In the embodiment, there is provided a movable member RMs which is fitted in the rod-shaped antenna WA attached to an apparatus case and engaged with a body side end WAs of the rod-shaped antenna WA. The movable member RMs abuts on a ram RM6 to be the actuator of a switch SW. The ram RM6 is pushed downward in the drawing by an extensible spring in the switch SW.

In a state shown in FIG. 8A, the rod-shaped antenna WA is stored. Therefore, the movable member RMs is pushed downward in the drawing and is thus stopped on the wall of a build-in antenna carrier CA. At this time, the switch SW is placed in a position in which the ram RM6 is protruded downward.

Next, when the rod-shaped antenna WA is pulled out, the body side end WAs pushes the movable member RMs upward to push the ram RM6 of the switch SW into the switch SW as shown in FIG. 8B.

Figure 9:
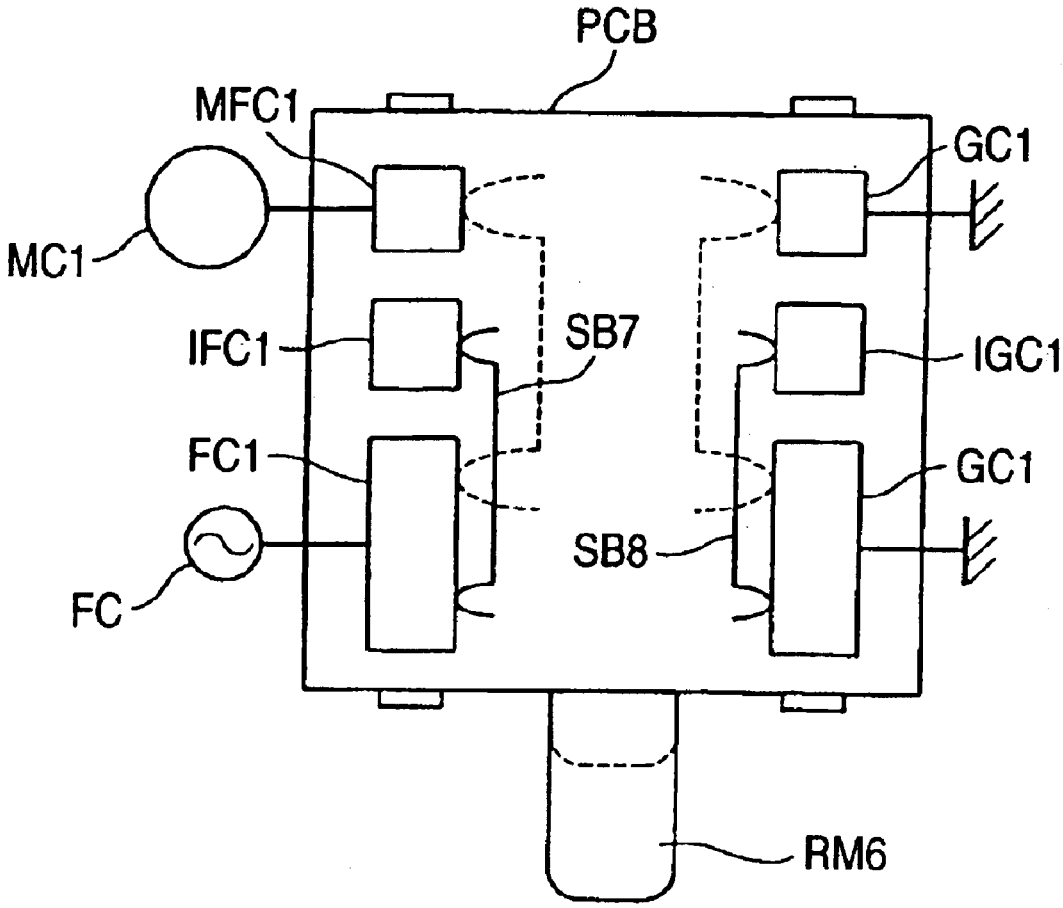
FIG. 9 is a detailed view illustrating the connecting relationship of the switch of the sixth embodiment.

FIG. 9 shows, in more detail, the connecting relationship of the switch SW of this embodiment. By the motion of the ram RM6 corresponding to the storage and pull-out of the rod-shaped antenna WA (not shown), a first switch member SB7 to be a movable contact member connects a feeding circuit FC to a built-in antenna feeding circuit or a matching circuit MC1 through terminals IFC1 and MFC1, and a second switch member SB8 to be another movable contact member connects a ground terminal GC to a built-in antenna ground terminal IGC1 or another ground terminal GC.

In the switch structure, a pair of switch members SB7 and SB8 are provided in parallel with each other, and the terminals GC1, IGC1, MFC1, IFC1 and FC1 are arranged in parallel in the same manner as the switch members SB7 and SB8. Therefore, there is an advantage that a line impedance can easily be adjusted.

More specifically, one of them can be used as a signal line and the other can be used as an earth line. By regulating a spacing between the lines and the dielectric constant of a dielectric material between both lines, it is possible to obtain a necessary line impedance and an enhanced performance of the VSWR, a lower insertion loss and an improved isolation.

Figure 10A:
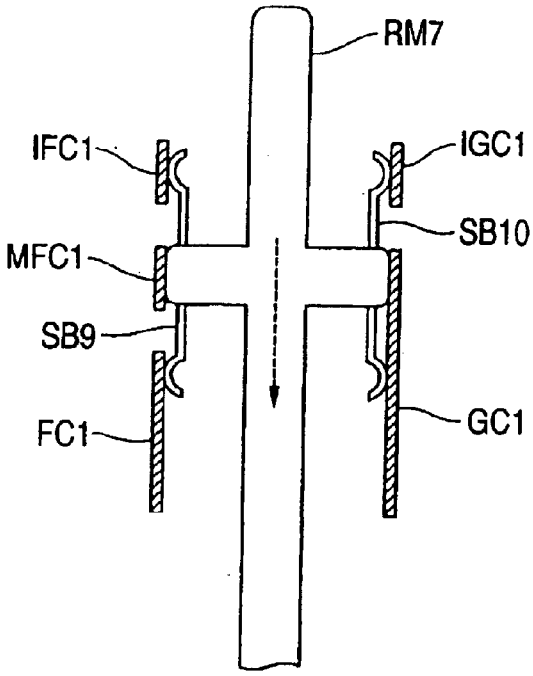
FIGS. 10A and 10B are views showing a switch according to a seventh embodiment of the invention.
Figure 10B:
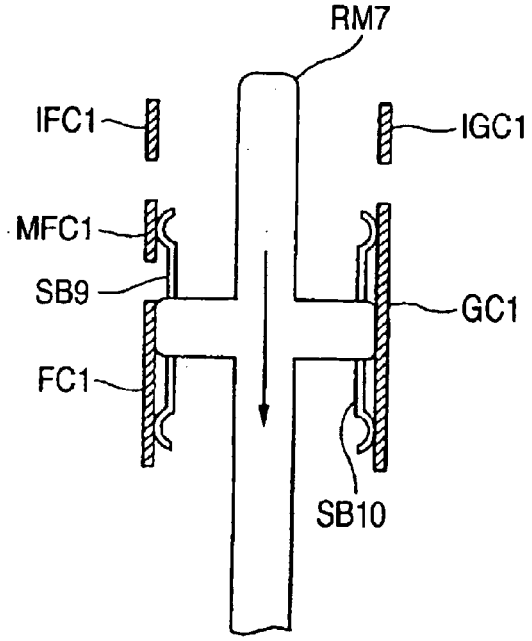

FIGS. 10A and 10B show a switch according to a seventh embodiment of the invention. FIG. 10A is a view showing a state in which a rod-shaped antenna is stored and FIG. 10B is a view showing a state in which the rod-shaped antenna is pulled out.

In this embodiment, the arrangement order of terminals provided in parallel in two lines on the left and right with a central ram RM7 interposed therebetween is different from that in the sixth embodiment. More specifically, a built-in antenna feeding terminal IFC1, a matching circuit terminal MFC1 and a feeding circuit terminal FC1 from the top in the drawing are provided for a first switch member SB9 to be a movable contact member. Correspondingly, a built-in antenna ground terminal IGC1 and an elongated ground terminal GC1 from the top of the drawing are provided for a second switch member SB10 to be another movable contact member.

Figure 11A:
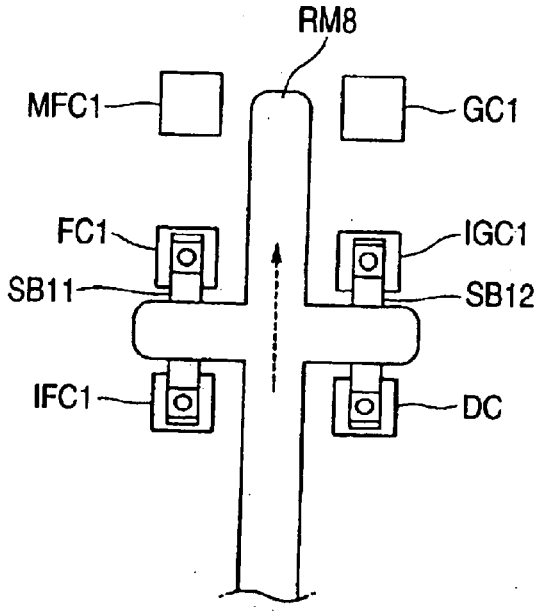
FIGS. 11A and 11B are views showing a switch according to an eighth embodiment of the invention.
Figure 11B:
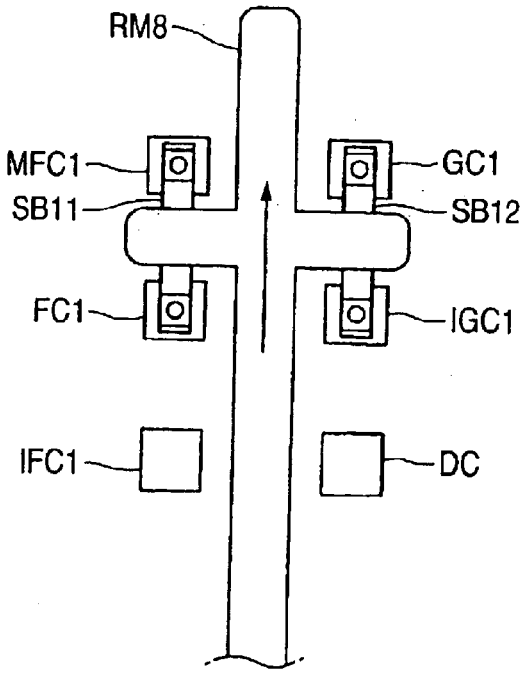

FIGS. 11A and 11B show a switch according to an eighth embodiment of the invention. This embodiment has the same arrangement order of switch members and terminals as those in the sixth embodiment, and is different in that a terminal has a planar structure. As a result, switch members SB11 and SB12 (movable contact members) moved by a ram RM8 also have planar structures corresponding to the terminals. FIG. 11A shows a state in which a rod-shaped antenna is stored and FIG. 11B shows a state in which the rod-shaped antenna is pulled out. A terminal DC provided on the second switch side is a dummy terminal or an RF board ground terminal.

In this example, by properly selecting a distance between the movable contact member and the earth of a circuit board PCB and the dielectric constant of a dielectric material provided on the bottom surface of the switch, it is possible to obtain a desired line impedance.

Figure 12A:
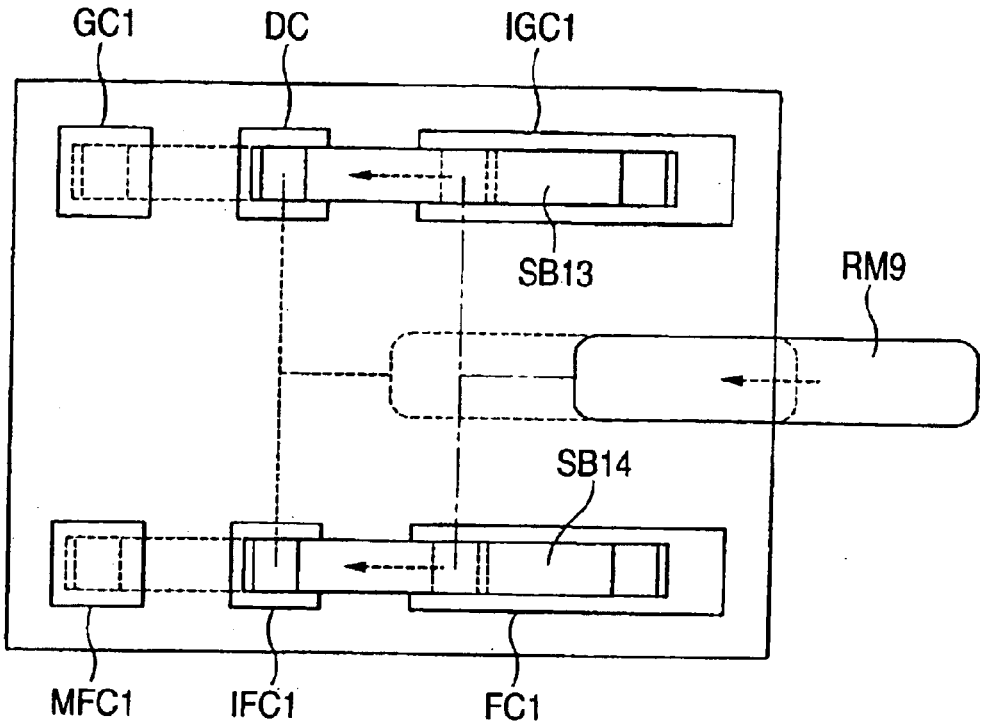
FIGS. 12A and 12B are a plan view and a side view showing a switch according to a ninth embodiment of the invention.
Figure 12B:
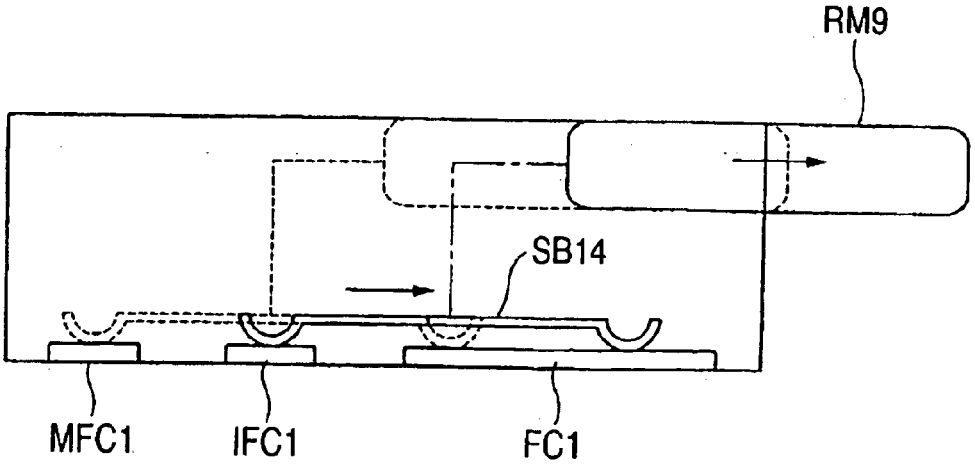

FIGS. 12A and 12B are a plan view and a side view showing a switch according to a ninth embodiment of the invention. By the motion of a ram RM9 corresponding to the storage and pull-out of a rod-shaped antenna (not shown), first and second switch members SB13 and SB14 slide, and come in contact with and separate from each terminal, thereby carrying out a switching connection.

Moreover, each component is subjected to proper shielding. Consequently, it is possible to enhance a high frequency characteristic indicated by the VSWR, the insertion loss property and the isolation property.

Figure 13A:
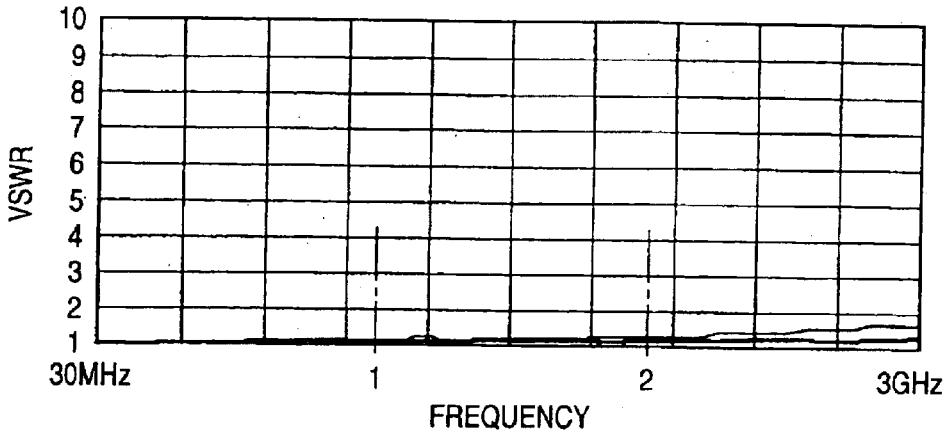
FIGS. 13A, 13B and 13C are characteristic charts showing a result of actual measurement indicative of the degree of an enhancement in voltage standing wave ratio, an insertion loss and an isolation when a switch is subjected to shielding.
Figure 13B:
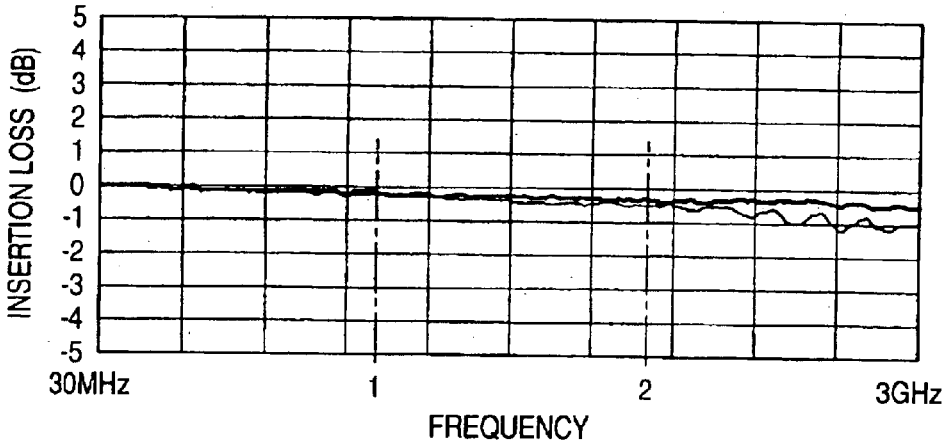
Figure 13C:
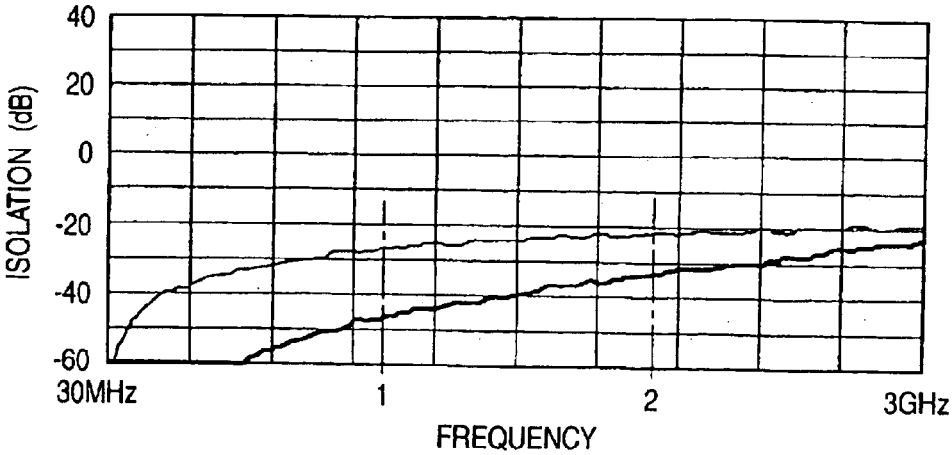
Figure 14A:
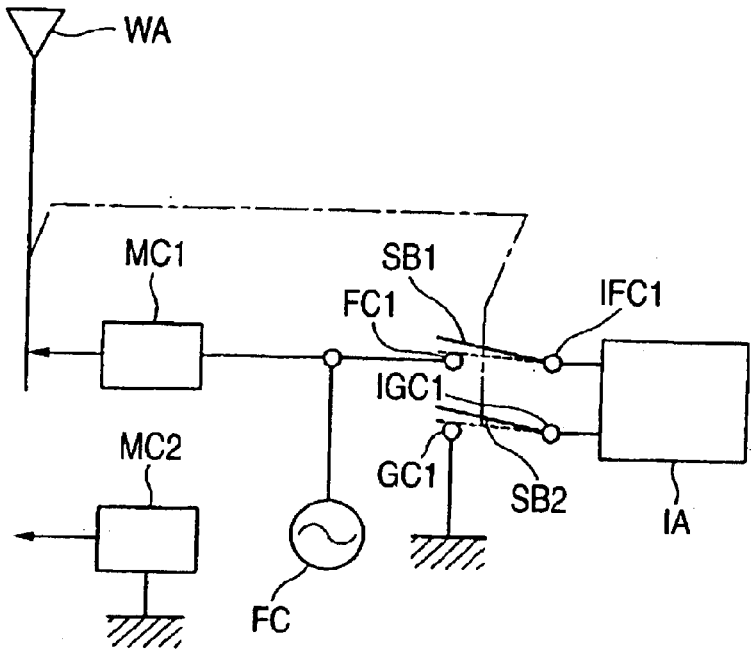
FIGS. 14A and 14B are diagrams showing a circuit structure of a related-art antenna device.
Figure 14B:
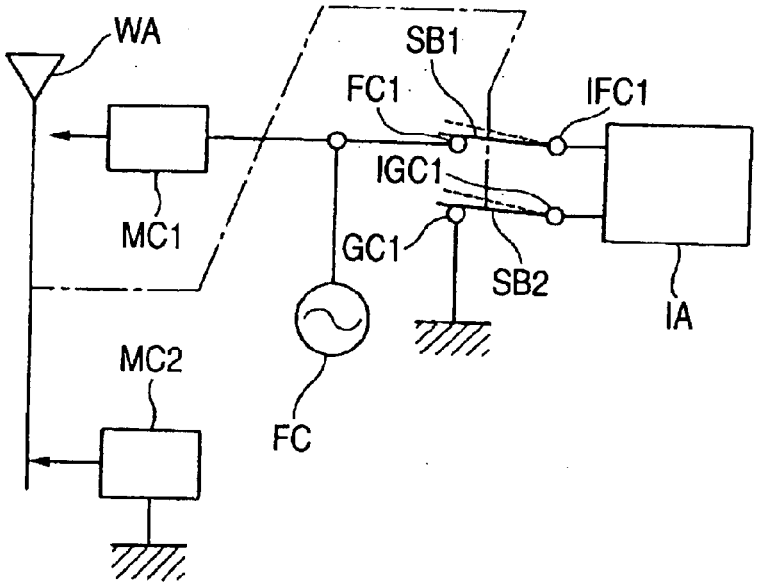
Figure 15A:
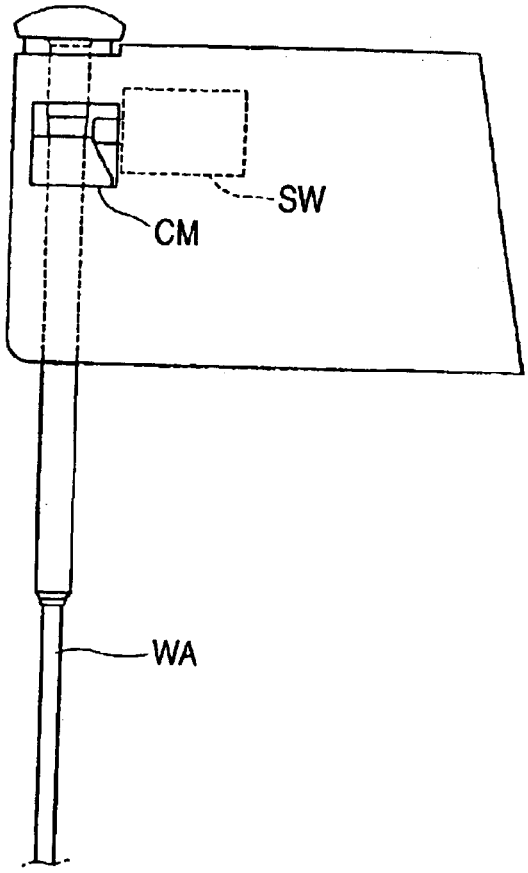
FIGS. 15A and 15B are views showing a structure for changing over a rod-shaped antenna and a built-in antenna shown in the related-art antenna device.
Figure 15B:
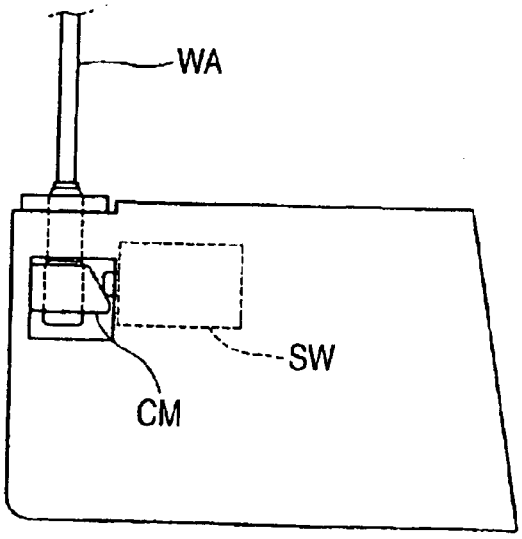

FIGS. 13A, 13B and 13C respectively show a result of actual measurement of the degree of an enhancement in the VSWR, the insertion loss property and the isolation property which is obtained by the shielding within a frequency range of 30 MHz to 3 GHz. A bold line indicates that the shielding is carried out and a narrow line indicates that the shielding is not carried out.

As shown in FIG. 13A, the VSWR was changed from 1.1595 (without shielding) to 1.0922 (with shielding) at 1 GHz, and was changed from 1.3057 (without shielding) to 1.1156 (with shielding) at 2 GHz.

As shown in FIG. 13B, the insertion loss property was changed from −0.2115 dB (without shielding) to −0.2061 dB (with shielding) at 1 GHz, and was changed from −0.5624 dB (without shielding) to −0.3317 dB (with shielding) at 2 GHz.

As shown in FIG. 13C, the isolation property was changed from 16.87 dB (without shielding) to 37.65 dB (with shielding) at 1 GHz, and was changed from 11.74 dB (without shielding) to 24.27 dB (with shielding) at 2 GHz.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

For example, the switch according to each of the embodiments is not restricted but can be replaced with a microswitch.

What is claimed is:

1. An antenna device, incorporated in a mobile communication terminal, comprising:

a first antenna, movable between a first position pulled out from the communication terminal and a second position accommodated in the communication terminal;

a second antenna, built in the communication terminal;

a power feeding circuit;

an impedance matching circuit;

a first switch, which electrically connects only the first antenna with the power feeding circuit via the impedance matching circuit when the first antenna is placed at the first position, and electrically connects only the second antenna with the power feeding circuit when the first antenna is placed at the second position; and a second switch, which grounds the second antenna in cooperation with the first switch, when the first antenna is placed at the second position.

2. The antenna device as set forth in claim 1, further comprising a circuit having a higher impedance than an impedance of the power feeding circuit, wherein the circuit is electrically connected to a ground path of the first antenna, when the first antenna is placed at the second position.

3. The antenna device as set forth in claim 1, further comprising a movable member which is reciprocally movable in accordance with the movement of the first antenna, wherein:

the first switch includes:

a first fixed contact, electrically connected to the first antenna;

a second fixed contact, electrically connected to the second antenna; and a first movable contact, electrically connected to the power feeding circuit and actuated by the movable member so as to be brought into contact with one of the first fixed contact and the second fixed contact; and the second switch includes:

a third fixed contact, electrically connected to a ground terminal of the power feeding circuit; and a second movable contact, electrically connected to the second antenna and actuated by the movable member so as to be brought into contact with or separated from the third fixed contact.

4. The antenna device as set forth in claim 3, further comprising a circuit board on which the power feeding circuit is mounted, wherein:

the movable member is disposed between the second antenna and the circuit board so as to approach either the second antenna or the circuit board in accordance with the movement of the first antenna;

the first fixed contact and the third fixed contact are provided on the circuit board;

the second fixed contact is provided on the second antenna; and the first movable contact and the second movable contact are provided on the movable member.

5. The antenna device as set forth in claim 4, wherein the first movable contact has two contact points to form a part of a signal line from the power feeding circuit to the first antenna.

6. The antenna device as set forth in claim 4, wherein the second switch includes a cylindrical casing accommodating therein a movable rod member and a spring member which urges the rod member toward the second antenna such that a contact between the rod member and the second antenna is maintained even if the movable member approaches the circuit board.

7. The antenna device as set forth in claim 3, further comprising:

an elastic member, which elastically urges the movable member in a direction that the first antenna is moved from the first position to the second position, so that the first movable contact is electrically connected to the second fixed contact, and the second movable contact is brought into contact with the third fixed contact; and an actuator, which follows the first antenna when the first antenna is moved from the second position to the first position, so as to move the movable member against an urging force of the elastic member such that the first movable contact is electrically connected to the first fixed contact, and the second movable contact is separated from the third fixed contact.

8. The antenna device as set forth in claim 7, wherein the first movable contact and the second movable contact are provided with the movable member.

9. The antenna device as set forth in claim 3, wherein the first switch and the second switch are disposed between the second antenna and the circuit board.

10. The antenna device as set forth in claim 1, wherein the first switch includes a first sub-switch which is electrically connected or disconnected with the impedance matching circuit, and a second sub-switch which is electrically connected or disconnected with a ground terminal of the second antenna.

11. The antenna device as set forth in claim 1, wherein at least one of the first switch and the second switch is a microswitch.

12. The antenna device as set forth in claim 1, wherein at least one of the first switch and the second switch is provided with a shielding member.

* * * * *